US009205543B1

(12) United States Patent
Chen et al.

(10) Patent No.: US 9,205,543 B1
(45) Date of Patent: Dec. 8, 2015

(54) DRIVING HEAD-CHANGEABLE TOOL

(71) Applicant: YUAN LI HSING INDUSTRIAL CO., LTD., Taichung (TW)

(72) Inventors: Hui-Chien Chen, Taichung (TW); Chia-Yi Chen, Taichung (TW)

(73) Assignee: YUAN LI HSING INDUSTRIAL CO., LTD., Taichung (TW)

( * ) Notice: Subject to any disclaimer, the term of this patent is extended or adjusted under 35 U.S.C. 154(b) by 42 days.

(21) Appl. No.: 14/316,793

(22) Filed: Jun. 26, 2014

(51) Int. Cl.
*B25B 13/00* (2006.01)
*B25B 23/00* (2006.01)
*B25B 13/06* (2006.01)

(52) U.S. Cl.
CPC ..... *B25B 23/0035* (2013.01); *B25B 13/06* (2013.01)

(58) Field of Classification Search
CPC ..... B25B 23/0035; B25B 13/06
USPC ..... 81/124.5, 124.6, 177.75, 177.7; 408/127; 279/16, 143
See application file for complete search history.

(56) References Cited

U.S. PATENT DOCUMENTS 6,321,855 B1 * 11/2001 Barnes ..... B25B 13/06 173/132
7,278,342 B1 * 10/2007 Chang ..... B25B 15/001 81/177.75
7,669,860 B2 * 3/2010 Chiang ..... B23B 31/008 279/128
7,942,426 B2 * 5/2011 Peters ..... B23B 51/12 279/143
8,366,339 B2 * 2/2013 Lin ..... F16C 11/0604 403/57

* cited by examiner

*Primary Examiner* — Monica Carter
*Assistant Examiner* — Melanie Alexander

(57) ABSTRACT

A driving head-changeable tool is provided, comprising an outer sleeve and an inner sleeve. The outer sleeve has an end peripheral edge and a non-circular circumferential inner wall. The end peripheral edge is formed with corner portions and blocking flanges. The inner sleeve has a non-circular circumferential outer wall. The inner sleeve is rotatably sleeved by the outer sleeve and has a first connecting end along a central axis. An inner wall of the first connecting end is formed with concaves extending axially. The non-circular circumferential inner and outer walls are nonrotatably abutted against each other. As viewed in an axial direction, each concave overlaps with one the blocking flange. When a driving head is inserted in the inner sleeve and the outer sleeve and the inner sleeve come close to each other, the driving head is blocked by the blocking flanges.

12 Claims, 6 Drawing Sheets

DRIVING HEAD-CHANGEABLE TOOL

BACKGROUND OF THE INVENTION

1. Field of the Invention

The present invention relates to a driving head, and more particularly to a driving head-changeable tool.

2. Description of the Prior Art

In prior art of two-part form of connecting head, a polygonal ball-shaped head of a support rod is received in a receiving slot of a working head. And the receiving slot corresponds to the polygonal ball-shaped head in shape. The support rod is assembled and fixed with the working head through a connecting structure. The support rod is pulled out and rotates relatively to the working head. This kind of connecting head is disclosed in TW566284 and TWM357344.

A structure as described in the TW566284, having an inner wall of the receiving slot formed as polygonal-shaped and contacting with the polygonal ball-shaped head through surfaces. When the support rod is driven to rotate relatively to the working head by an electrical driving device with a high speed, the receiving slot and the polygonal ball-shaped head are easily blocked because of friction between each other. Also, the electrical device and the two-part form of connecting head are damaged. Furthermore, the friction also causes energy loss and makes work efficiency worse.

A structure as described in the TWM357344, having a lateral wall of the receiving slot formed with protruding flanges corresponding to the polygonal ball-shaped head. The protruding flanges are equal spaced-apart and longitudinally disposed on the lateral wall. A number of the protruding flanges corresponds to the polygonal ball-shaped head. Each of the protruding flanges includes a camber surface for contacting with the polygonal ball-shaped head. The support rod and the working head are linking-up in rotation and it improves the disadvantages in the TW566284.

However, either TW566284 or TWM357344 has a structure which is unformed with blocking flanges to block corner portions of the polygonal ball-shaped head. The driving head easily prolapses, and it stops the work, reduces work efficiency and causes secure problems.

The present invention has arisen to mitigate and/or obviate the afore-described disadvantages.

SUMMARY OF THE INVENTION

The primary object of the present invention is to provide a driving head-changeable tool, having a structure for preventing the driving head from prolapsing and convenient to change the driving head. The driving head can rotate and has better work efficiency. The structure also has fewer members, and the structure is simple and easy for assembling.

To achieve the above object, a driving head-changeable tool is provided, comprising an outer sleeve and an inner sleeve. The outer sleeve defines a central axis and has an end peripheral edge and a non-circular circumferential inner wall. The end peripheral edge is formed with a plurality of corner portions and a plurality of blocking flanges located between the corner portions. A distance from the corner portion to the central axis is greater than a distance from the blocking flange to the central axis. The inner sleeve has a non-circular circumferential outer wall, is detachably sleeved by the outer sleeve and has a first connecting end along the central axis. An inner wall of the first connecting end is formed with a plurality of concaves extending axially and a first end face facing the blocking flanges. The non-circular circumferential inner and outer walls are nonrotatably abutted against each other. A distance from the concave to the central axis is smaller than a distance from the blocking flange to the central axis. As viewed in an axial direction, each concave overlaps with one the blocking flange. When a distance between the first end face and the end peripheral edge is equal to or greater than a predetermined distance, a driving head is able to be inserted in the outer sleeve and rotatable relative to the outer sleeve. The driving head includes a first end. The first end includes a plurality of abutting corner portions extending axially and formed on a circumferential surface and a second end surface. A maximum distance from the abutting corner portions to the central axis is smaller than a distance from the blocking flange to the central axis. A distance from a maximum outer diameter of the abutting corner portions to the second end surface is equal to or smaller than the predetermined distance. The first end is detachably inserted in the first connecting end. When each of the abutting corner portions rotates to correspond to one the concave, each of the abutting corner portions is blockably received within the corresponding concave. And when the first end face and the blocking flanges come close to each other, the first end of the driving head is blocked in the first connecting end by the blocking flanges.

A driving head-changeable tool is also provided, comprising an outer sleeve and an inner sleeve. The outer sleeve defines a central axis and has an end peripheral edge and a non-circular circumferential inner wall. The end peripheral edge is formed with a plurality of corner portions and a plurality of blocking flanges located between the corner portions. A distance from the corner portion to the central axis is greater than a distance from the blocking flange to the central axis. A first end of a driving head is received in the outer sleeve. The first end is formed with a plurality of abutting corner portions extending axially on a circumferential surface. A maximum distance from the abutting corner portions to the central axis is smaller than a distance from the blocking flange to the central axis. As viewed in an axial direction, each of the abutting corner portions is opposite to one the blocking flange. An inner sleeve has a non-circular circumferential outer wall and is detachably sleeved by the outer sleeve. The inner sleeve has a first connecting end along the central axis. An inner wall of the first connecting end is formed with a plurality of concaves extending axially. A distance from the concave to the central axis is smaller than a distance from the blocking flange to the central axis. As viewed in an axial direction, each concave overlaps with one the blocking flange. The concaves correspond to the abutting corner portions and the first connecting end is inserted on the first end of the driving head. Each of the abutting corner portions is received in the corresponding concave and the non-circular circumferential inner and outer walls are nonrotatably abutted against each other. When the first connecting end and the blocking flanges come close to each other, the first end of the driving head is blocked in the first connecting end by the blocking flanges.

DETAILED DESCRIPTION OF THE PREFERRED EMBODIMENTS

Figure 1:
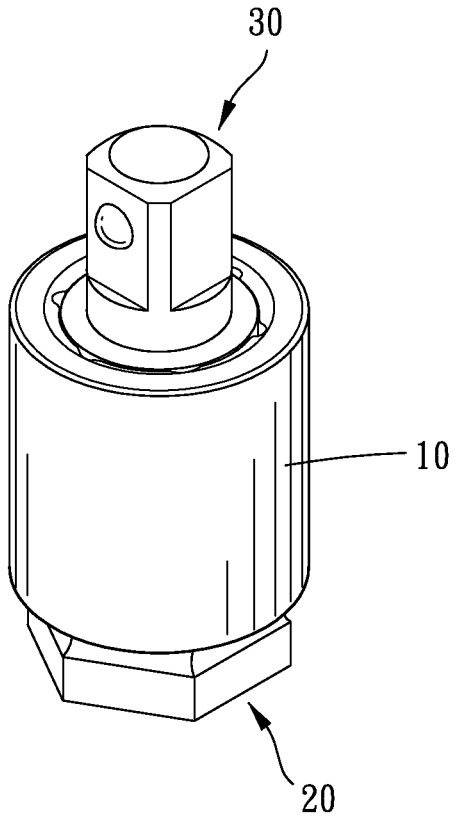
FIG. 1 is a three-dimensional drawing of a driving head-changeable tool in accordance with a preferable embodiment of the present invention.

The present invention will be clearer from the following description when viewed together with the accompanying drawings, which show, for purpose of illustrations only, the preferred embodiment in accordance with the present invention.

Referring to FIGS. 1-3, 3A, 4 and 4A, a driving head-changeable tool in accordance with a preferred embodiment of the present invention comprises an outer sleeve 10 and an inner sleeve 20.

The outer sleeve 10 defines a central axis 11. The outer sleeve 10 has an end peripheral edge 12 and a non-circular circumferential inner wall 13 (such as a hexagonal pillar). The end peripheral edge 12 is formed with a plurality of corner portions 14 and a plurality of blocking flanges 15 located between the corner portions 14. A distance from the corner portion 14 to the central axis 11 is greater than a distance from the blocking flange 15 to the central axis 11. Moreover, each of the blocking flanges 15 is flatly and straightly connected between the two corner portions 14 adjacent to each other. Compared with the two adjacent blocking flanges 15, each of the corner portions 14 is invaginated radially in the end peripheral edge 12.

Figure 4:
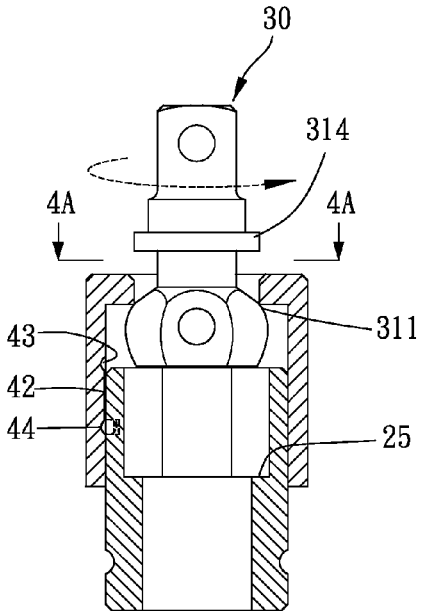
FIG. 4 is another cross-sectional drawing of the driving head-changeable tool in accordance with the preferable embodiment of the present invention.
Figure 3A:
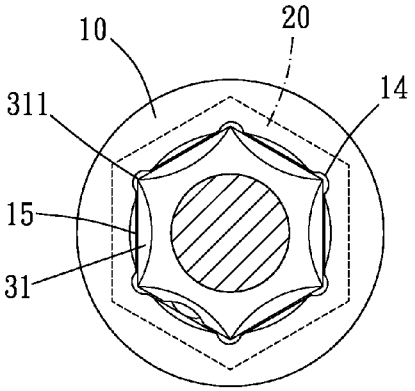
FIG. 3A is a cross-sectional drawing along 3A-3A in FIG. 3.
Figure 4A:
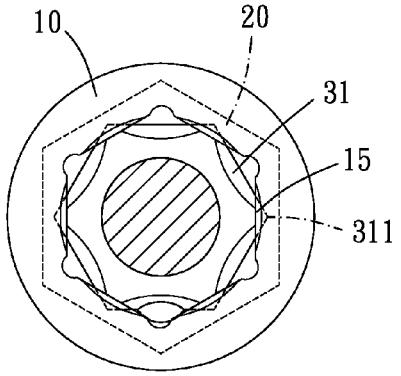
FIG. 4A is a cross-sectional drawing along 4A-4A in FIG. 4.

The inner sleeve 20 has a non-circular circumferential outer wall 21. Practically, the non-circular circumferential outer wall 21 corresponds to the non-circular circumferential inner wall 13 in shape and in dimension. The inner sleeve 20 is detachably sleeved by the outer sleeve 10 and has a first connecting end 22 along the central axis. An inner wall of the first connecting end 22 is formed with a plurality of concaves 23 extending axially and a first end face 24 facing the blocking flanges 15. The non-circular circumferential inner and outer walls 13, 21 are nonrotatably abutted against each other. A distance from the concave 23 to the central axis 11 is smaller than a distance from the blocking flange 15 to the central axis 11. When a distance between the first end face 24 and the end peripheral edge 12 is equal to or greater than a predetermined distance, a driving head 30 is able to be inserted in the outer sleeve 10 and rotatable relative to the outer sleeve 10. As viewed in an axial direction, each of the concaves 23 overlaps with one the blocking flange 15 (as shown in FIGS. 4 and 4A).

The driving head 30 includes a first end 31, and the first end 31 includes a plurality of abutting corner portions 311 axially extending and formed on a circumferential surface and a second end surface 312. A maximum distance from the abutting corner portions 311 to the central axis 11 is smaller than a distance from the blocking flange 15 to the central axis 11. A distance from a maximum outer diameter of the abutting corner portions 311 to the second end surface 312 is equal to or smaller than the predetermined distance. In the present embodiment, the first end 31 is formed with a polygonal ball-shaped head 313 and a radial protruding flange 314. A necking shape is formed between the polygonal ball-shaped head 313 and the radial protruding flange 314. A second end 315 of the driving head 30 is formed with a quadrilateral connecting head 316. The quadrilateral connecting head 316 is for connecting with a driving device, a switching head, a screw driver or a driller and so on.

The first end 31 is detachably inserted in the first connecting end 22. When each of the abutting corner portions 311 rotates to correspond to one the concave 23, each of the abutting corner portions 311 is blockably received within the corresponding concave 23. When the first end face 24 and the blocking flanges 15 come close to each other, the first end 31 of the driving head 30 is blocked in the first connecting end 22 by the blocking flanges 15 (as shown in FIGS. 4 and 4A).

The driving head-changeable tool further includes an abutting mechanism 40. The abutting mechanism 40 includes an abutting body 41 retractably disposed protrusively on the non-circular circumferential inner wall 13 or the non-circular circumferential outer wall 21, and the abutting body 41 abuts against between the non-circular circumferential inner and outer walls 13, 21. Preferably, the abutting mechanism 40 further includes an axial extending slot 42 formed on one of the non-circular circumferential inner and outer walls 13, 21. The other of the non-circular circumferential inner and outer walls 13, 21 is provided with the abutting body 41, and the abutting body 41 is movably disposed in the axial extending slot 42. The axial extending slot 42 preferably includes at least one enlarged and recessed positioning slot portion. The at least one positioning slot portion includes a first positioning slot portion 43 close to the end peripheral edge 12 and a second positioning slot portion 44 far away from the end peripheral edge 12. When the abutting body 41 abuts against the first positioning slot portion 43, a distance between the first end face 24 and the end peripheral edge 12 is smaller than the predetermined distance. When the abutting body 41 abuts against the second positioning slot portion 44, the distance between the first end face 24 and the end peripheral edge 12 is equal to or greater than the predetermined distance. The outer sleeve 10 and the inner sleeve 20 are positioned with each other on a predetermined position by the abutting mechanism 40.

Preferably, an inner wall of the first connecting end 22 of the inner sleeve 20 is formed with a stepped surface 25 facing the first end 31 of the driving head 30. When the radial protruding flange 314 abuts against the end peripheral edge 12, the second end surface 312 of the first end 31 abuts against the stepped surface 25. The driving head 30 is assembled with the inner sleeve 20 and the outer sleeve 10 solidly, and it is durable and can be applied to such as dynamic impact tools.

Figure 2:
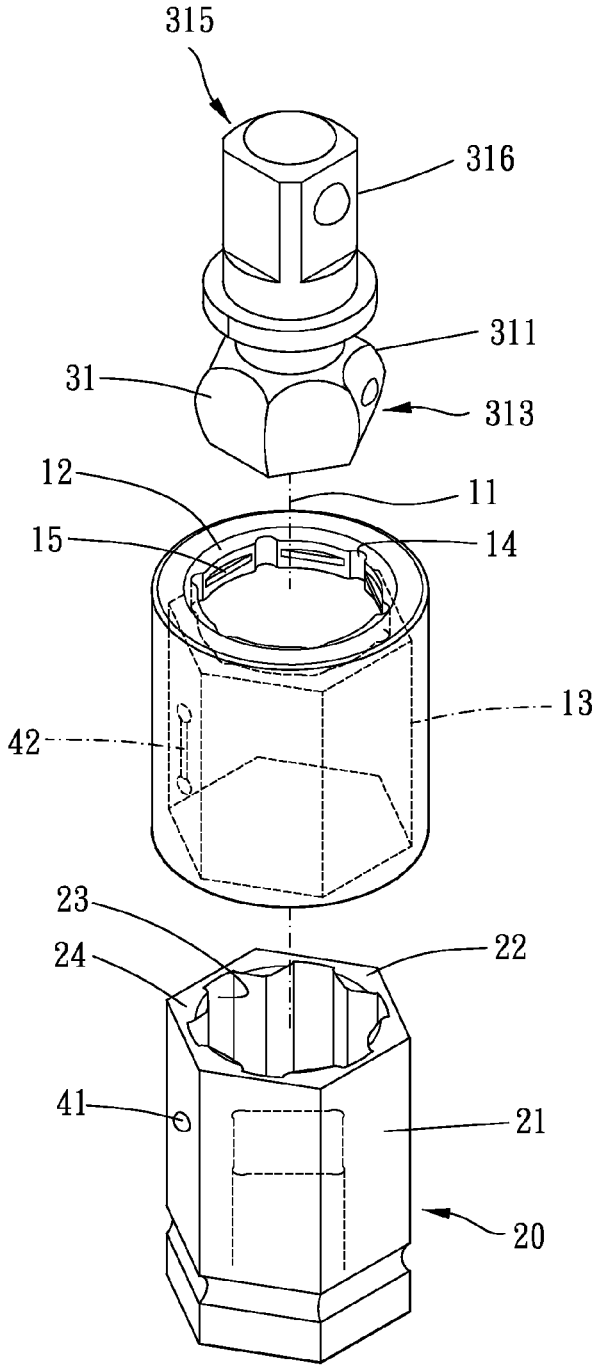
FIG. 2 is a breakdown drawing of the driving head-changeable tool in accordance with the preferable embodiment of the present invention.
Figure 3:
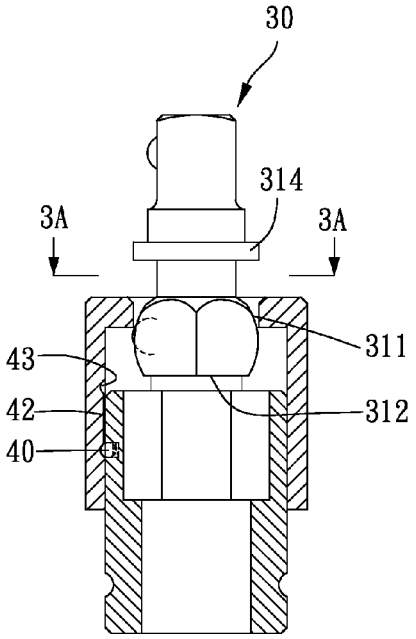
FIG. 3 is a cross-sectional drawing of the driving head-changeable tool in accordance with the preferable embodiment of the present invention.
Figure 5:
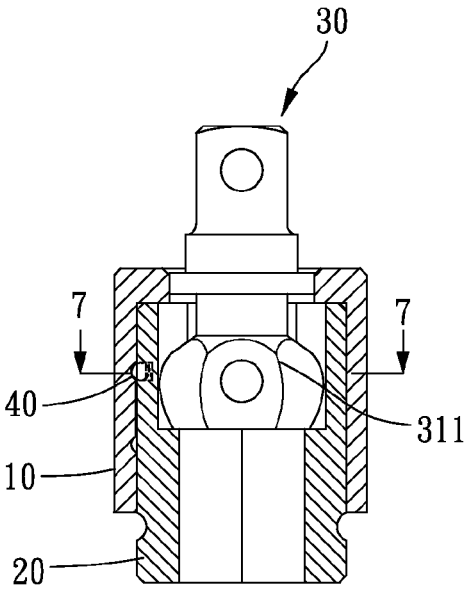
FIGS. 5 and 6 are cross-sectional drawings of the driving head-changeable tool in accordance with the preferable embodiment of the present invention in assembly.
Figure 8:
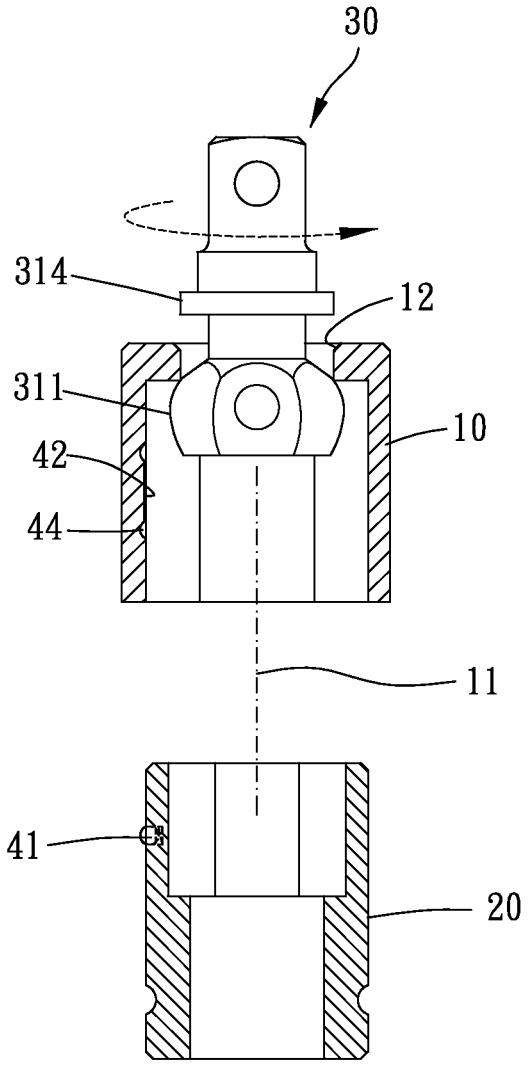
FIG. 8 is a cross-sectional drawing of the driving head-changeable tool in accordance with another preferable embodiment of the present invention.

Referring to FIG. 8 and with further reference to FIGS. 2 and 5, in another embodiment, wherein the same members as described above are represented with the same symbols, the driving head-changeable tool includes an outer sleeve 10 and an inner sleeve 20. The outer sleeve 10 defines a central axis 11 and has an end peripheral edge 12 and a non-circular circumferential inner wall 13. The end peripheral edge 12 is formed with corner portions and a plurality of blocking flanges 15 located between the corner portions 14. A distance from the corner portion 14 to the central axis 11 is greater than a distance from the blocking flange 15 to the central axis 11. A first end 31 of a driving head 30 is received in the outer sleeve 10. The first end 31 is formed with a plurality of abutting corner portions 311 extending axially on a circumferential surface. A maximum distance from the abutting corner portions 311 to the central axis 11 is smaller than a distance from the blocking flange 15 to the central axis 11. As viewed in an axial direction, each of the abutting corner portions 311 is opposite to one the blocking flange 15. The inner sleeve 20 has a non-circular circumferential outer wall 21 and is detachably sleeved by the outer sleeve 10. The inner sleeve 20 has a first connecting end 22 along the central axis. An inner wall of the first connecting end 22 is formed with a plurality of concaves 23 extending axially. A distance from the concave 23 to the central axis 11 is smaller than a distance from the blocking flange 15 to the central axis 11. As viewed in an axial direction, each concave 23 overlaps with one the blocking flange 15. The concaves 23 correspond to the abutting corner portions 311 and the first connecting end 22 inserted on the first end 31 of the driving head. Each of the abutting corner portions 311 is received in the corresponding concave 23 and the non-circular circumferential inner and outer walls 13, 21 are nonrotatably abutted against each other. When the first connecting end 22 and the blocking flanges 15 come close to each other, the first end 31 of the driving head is blocked in the first connecting end 22 by the blocking flanges 15.

The driving head-changeable tool further includes an abutting mechanism 40. The abutting mechanism 40 includes an abutting body 41 retractably disposed protrusively on the non-circular circumferential inner wall 13 or the non-circular circumferential outer wall 21, and the abutting body 41 abuts against between the non-circular circumferential inner and outer walls 13, 21. The abutting mechanism 40 has the same structure as described above, and it will not be described.

Figure 6:
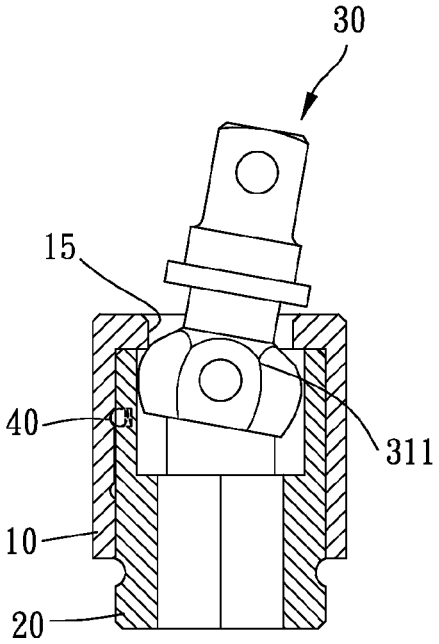
Figure 7:
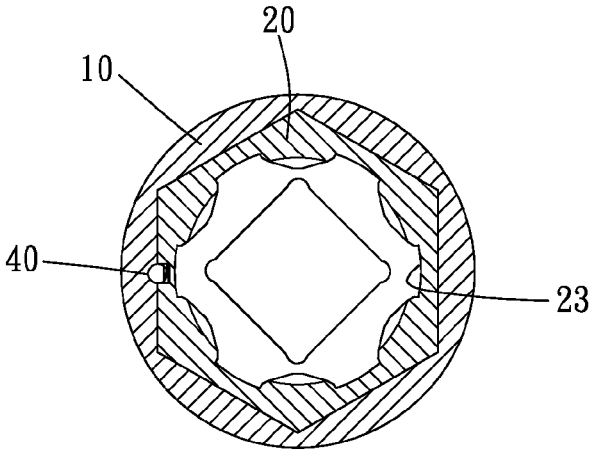
FIG. 7 is a cross-sectional drawing along 7-7 in FIG. 5.

Referring to FIGS. 3-6, practically, a distance between the first end face 24 and the end peripheral edge 12 is equal to or greater than the predetermined distance, and the first end 31 of the driving head is able to be inserted in the first connecting end 22 of the inner sleeve 20 and rotatable so that each of the abutting corner portions 311 corresponds to each of the concaves 23 and each of the blocking flanges 15. When each of the abutting corner portions 311 rotates to correspond to one the concave 23, each of the abutting corner portions 311 is blockably received within the corresponding concave 23. When the outer sleeve 10 and the inner sleeve 20 come close to each other, the first end 31 of the driving head is blocked in the first connecting end 22 by the blocking flanges 15. When the radial protruding flange unabuts against the end peripheral edge, the driving head is rotatable relatively to the inner sleeve and the outer sleeve via the polygonal ball-shaped head. Or the first end 31 of the driving head is received in the outer sleeve 10, and each of the abutting corner portions 311 is opposite to one the blocking flange 15 (as shown in FIG. 8), and then the outer sleeve 10 and the inner sleeve 20 are inserted to each other. The first end 31 of the driving head is blocked in the first connecting end 22 by the blocking flange 15 (as shown in FIGS. 5 and 6).

Figure 9:
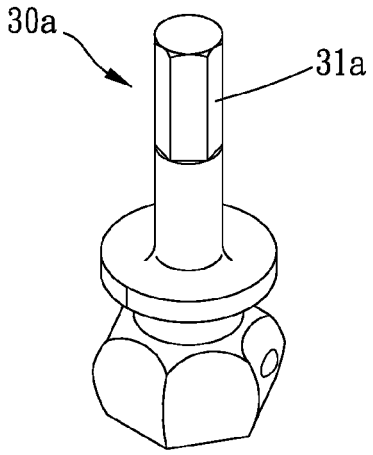
FIGS. 9-11 are perspective drawings of the driving head-changeable tool in accordance with embodiments of the present invention with different driving heads.
Figure 10:
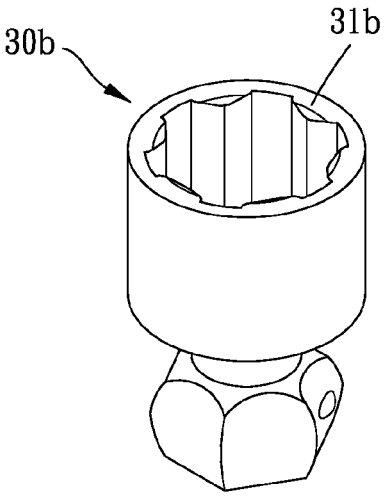
Figure 11:
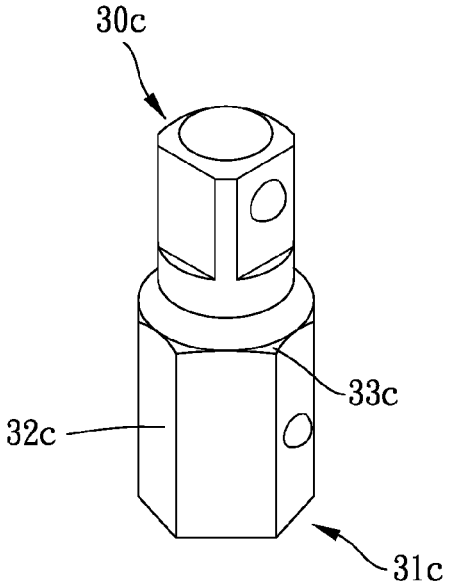

The driving head can be a type such as polygonal ball-shaped as described above and a driving head 30*a* of a driving head-changeable tool as shown in FIG. 9. The second end of the driving head 30*a* is formed with a hexagonal pillar 31*a* (can be used as a hexagonal wrench). Referring to FIG. 10, it shows a driving head 30*b* in an embodiment of the driving head-changeable tool. The second end of the driving head 30*b* is formed with a sleeve 31*b*, and it can be other types such as a screw driver or a driller and so on. Referring to FIG. 11, a driving head 30*c* is formed with a straight polygonal rod 32*c* on a first end 31*c*. As viewed in an axial direction, when each of abutting corner portions 33*c* of the straight polygonal rod 32*c* overlaps one the blocking flange, it prevents the driving head 30*c* from prolapsing.

As a conclusion, the outer sleeve and the inner sleeve are inserted to each other through non-circular circumferential walls so that each blocking flange blocks each abutting corner portion of a driving head and it prevents that the driving head prolapses from the inner sleeve, and the driving head is convenient to change. Fewer members are needed, and a structure is simple and easy for assembling.

Besides, the outer sleeve and the inner sleeve are assembled to each other through non-circular circumferential walls so that it has a structure with better strength. The structure is durable under high-speed or/and high-torque working.

Furthermore, a driving head of driving head-changeable tool in this prevention is rotatable relatively to an inner sleeve and an outer sleeve so that the driving head can be used in some work places with limited space to tighten/release fasteners (such as screws or bolts). Moreover, each abutting corner portion of the driving head is blocked by the corresponding blocking flange so that it prevents the driving head from prolapsing and helps to work effectively and securely.

While we have shown and described various embodiments in accordance with the present invention, it should be clear to those skilled in the art that further embodiments may be made without departing from the scope of the present invention.

What is claimed is:

1. A driving head-changeable tool, comprising:

an outer sleeve, defining a central axis, having an end peripheral edge and a non-circular circumferential inner wall, the end peripheral edge formed with a plurality of corner portion and a plurality of blocking flange located between the corner portions, a distance from the corner portion to the central axis greater than a distance from the blocking flange to the central axis;

an inner sleeve, having a non-circular circumferential outer wall, detachably sleeved by the outer sleeve, having a first connecting end along the central axis, an inner wall of the first connecting end formed with a plurality of concaves extending axially and a first end face facing the blocking flanges, the non-circular circumferential inner and outer walls nonrotatably abutted against each other, a distance from the concave to the central axis smaller than the distance from the blocking flange to the central axis, as viewed in an axial direction, each concave overlapping with one the blocking flange, when a distance between the first end face and the end peripheral edge equal to or greater than a predetermined distance, a driving head is able to be inserted in the outer sleeve and rotatable relative to the outer sleeve;

wherein the driving head includes a first end, the first end includes a plurality of abutting corner portions extending axially and formed on a circumferential surface and a second end surface, a maximum distance from the abutting corner portions to the central axis is smaller than the distance from the blocking flange to the central axis, a distance from a maximum outer diameter of the abutting corner portions to the second end surface is equal to or smaller than the predetermined distance, the first end is detachably inserted in the first connecting end, when each of the abutting corner portions rotates to correspond to one the concave, each of the abutting corner portions is blockably received within the corresponding concave, and when the first end and the blocking flanges come close to each other, the first end of the driving head is blocked in the first connecting end by the blocking flanges.

2. The driving head-changeable tool as claimed in claim 1, further including an abutting mechanism, the abutting mechanism includes an abutting body retractably disposed protrusively on the non-circular circumferential inner wall or the non-circular circumferential outer wall, and the abutting body abuts against between the non-circular circumferential inner and outer walls.

3. The driving head-changeable tool as claimed in claim 2, wherein the abutting mechanism further includes an axial extending slot formed on either of the non-circular circumferential inner and outer walls, the other of the non-circular circumferential inner and outer walls is provided with the abutting body, and the abutting body is movably disposed on the axial extending slot.

4. The driving head-changeable tool as claimed in claim 3, wherein the axial extending slot further includes at least one enlarged and recessed positioning slot portion.

5. The driving head-changeable tool as claimed in claim 4, wherein the at least one positioning slot portion includes a first positioning slot portion close to the end peripheral edge and a second positioning slot portion far away from the end peripheral edge, when the abutting body abuts against the first positioning slot portion, a distance between the first end face and the end peripheral edge is smaller than the predetermined distance, when the abutting body abuts against the second positioning slot portion, the distance between the first end face and the end peripheral edge is equal to or greater than the predetermined distance.

6. The driving head-changeable tool as claimed in claim 1, wherein the first end is formed with a polygonal ball-shaped head and a radial protruding flange, when the radial protruding flange abuts against the end peripheral edge, the driving head is restrainedly positioned by the inner sleeve and the outer sleeve, when the radial protruding flange unabuts against the end peripheral edge, the driving head is rotatable relatively to the inner sleeve and the outer sleeve via the polygonal ball-shaped head.

7. The driving head-changeable tool as claimed in claim 1, wherein the first end is formed with a straight polygonal rod.

8. A driving head-changeable tool is provided, comprising:

an outer sleeve, defining a central axis, having an end peripheral edge and a non-circular circumferential inner wall, the end peripheral edge formed with a plurality of corner portion and a plurality of blocking flange located between the corner portions, a distance from the corner portion to the central axis greater than a distance from the blocking flange to the central axis, a first end of a driving head received in the outer sleeve, the first end formed with a plurality of abutting corner portions extending axially on a circumferential surface, a maximum distance from the abutting corner portions to the central axis smaller than a distance from the blocking flange to the central axis, as viewed in an axial direction, each of the abutting corner portions opposite to one the blocking flange;

an inner sleeve, having a non-circular circumferential outer wall, detachably sleeved by the outer sleeve, having a first connecting end along the central axis, an inner wall of the first connecting end formed with a plurality of concaves extending axially, a distance from the concave to the central axis smaller than the distance from the blocking flange to the central axis, as viewed in an axial direction, each concave overlapping with one the blocking flange, the concaves corresponding to the abutting corner portions and the first connecting end inserted on the first end of the driving head, each of the abutting corner portions received in the corresponding concave and the non-circular circumferential inner and outer walls nonrotatably abutted against each other;

wherein when the first connecting end and the blocking flanges come close to each other, the first end of the driving head is blocked in the first connecting end by the blocking flanges.

9. The driving head-changeable tool as claimed in claim 8, further including an abutting mechanism, the abutting mechanism includes an abutting body retractably disposed protrusively on the non-circular circumferential inner wall or the non-circular circumferential outer wall, and the abutting body abuts against between the non-circular circumferential inner and outer walls.

10. The driving head-changeable tool as claimed in claim 8, wherein the first end is formed with a polygonal ball-shaped head and a radial protruding flange, when the radial protruding flange abuts against the end peripheral edge, the driving head is restrainedly positioned by the inner sleeve and the outer sleeve, when the radial protruding flange unabuts against the end peripheral edge, the driving head is rotatable relatively to the inner sleeve and the outer sleeve via the polygonal ball-shaped head.

11. The driving head-changeable tool as claimed in claim 10, wherein an inner wall of the first connecting end is formed with a stepped surface facing the first end of the driving head, when the radial protruding flange abuts against the end peripheral edge, an end surface of the first end abuts against the stepped surface.

12. The driving head-changeable tool as claimed in claim 8, wherein the first end is formed with a straight polygonal rod.

* * * * *